US011098956B2

(12) United States Patent
Blumenthal et al.

(10) Patent No.: US 11,098,956 B2
(45) Date of Patent: Aug. 24, 2021

(54) PLATE HEAT EXCHANGER SYSTEM

(71) Applicant: Gebr. Kemper GmbH + Co. KG Metallwerke, Olpe (DE)

(72) Inventors: Roland Blumenthal, Erftstadt (DE); Tobias Theile, Drolshagen (DE)

(73) Assignee: GEBR. KEMPER GMBH + CO. KG METALLWERKE, Olpe (DE)

( * ) Notice: Subject to any disclaimer, the term of this patent is extended or adjusted under 35 U.S.C. 154(b) by 1242 days.

(21) Appl. No.: 15/161,093

(22) Filed: May 20, 2016

(65) Prior Publication Data

US 2016/0341485 A1 Nov. 24, 2016

(30) Foreign Application Priority Data

May 22, 2015 (DE) ..... 20 2015 003 756.9

(51) Int. Cl.
*F28D 9/00* (2006.01)
*F28F 19/00* (2006.01)
*F24D 19/00* (2006.01)

(52) U.S. Cl.
CPC ..... *F28D 9/0093* (2013.01); *F24D 19/0092* (2013.01); *F28D 9/00* (2013.01); *F28F 19/00* (2013.01); *F28F 2280/00* (2013.01)

(58) Field of Classification Search
CPC . F28D 9/0093; F28D 9/00; F28D 9/02; F24D 19/0092; F28F 19/00; F28F 2280/00; F28F 19/0092
USPC ..... 165/167, 166
See application file for complete search history.

(56) References Cited

U.S. PATENT DOCUMENTS 3,495,656 A * 2/1970 Dickson ..... F28F 9/026 165/166
4,235,679 A * 11/1980 Swaidan ..... B01D 5/0066 202/234
5,897,850 A * 4/1999 Borsboom ..... B01D 53/52 23/293 S (Continued)

FOREIGN PATENT DOCUMENTS

DE 20 2008 003 349 U1 10/2008
DE 10 2010 018 086 A1 10/2011

(Continued)

OTHER PUBLICATIONS

German Search Report for DE 20 2015 003 756.9 dated Mar. 15, 2016.

*Primary Examiner* — Tho V Duong
*Assistant Examiner* — Raheena R Malik
(74) *Attorney, Agent, or Firm* — Fay Sharpe LLP

(57) ABSTRACT

The present invention relates to a plate heat exchanger system with a plate heat exchanger (10) comprising an inlet (11) and an outlet (12) of a primary circuit (13), an inlet (14) and an outlet (15) of a secondary circuit (16), at least one plate (17) separating the two circuits in a housing of the plate heat exchanger from each other, and preferably a pipe which connects the primary circuit to a heating device. For improving heat transfer between the primary circuit (13) and the secondary circuit (16), the plate heat exchanger (10) is according to the invention in the direction of gravity (G) arranged such that the plane (E), in which the plate (17) is located, is inclined relative to the gravity vector (G) and the horizontal (H).

4 Claims, 2 Drawing Sheets

(56) References Cited

U.S. PATENT DOCUMENTS

| | | | | |
|---|---|---|---|---|
| 6,449,970 | B1 * | 9/2002 | Gagliano | B67D 1/0006 62/196.4 |
| 6,598,417 | B1 * | 7/2003 | Wilkes | B67D 1/0861 222/146.6 |
| 2010/0107438 | A1 * | 5/2010 | Bringewatt | D06F 39/006 34/467 |
| 2018/0135870 | A1 * | 5/2018 | Theile | F24D 17/0073 |

FOREIGN PATENT DOCUMENTS

| | | | | |
|---|---|---|---|---|
| DE | 102010018086 | A1 * | 10/2011 | F28D 9/005 |
| EP | 2 469 193 | A2 | 6/2012 | |

* cited by examiner

PLATE HEAT EXCHANGER SYSTEM

This application claims priority to DE 20-2015-003-756.9, filed May 22, 2015.

BACKGROUND

The present invention relates to a plate heat exchanger system with a plate heat exchanger comprising an inlet and an outlet of a primary circuit, an inlet and an outlet of a secondary circuit and at least one plate that separates the two circuits from each other within a housing of the plate heat exchanger. Furthermore, the plate heat exchanger system comprises a pipe connecting the primary circuit to a heating device.

The object of such a plate heat exchanger is fluid separation between the fluid of the secondary circuit to be heated and the fluid of the primary circuit introducing this heat. This can be, for example, fluid adapted for heat transfer and convective passage to which, for example, anti-corrosion agent or the like is added. The fluid from the secondary circuit, however, is commonly consumed. Sometimes this fluid must meet special requirements in terms of quality, in particular when the fluid is to be drawn from the secondary circuit as drinking water or service water, respectively.

The plate heat exchangers in such a plate heat exchanger system are usually designed as counter-flow heat exchangers. It is known in prior art to install the plate heat exchangers standing upright or lying horizontally. In this installation position, the plate heat exchangers are prone to calcification since temperature equalization after a tapping operation occurs only by way of heat conduction and thereby very slowly. The portion of the fluid or fluids, respectively, which is hotter during the tapping process remains hot for a longer period of time. This gives rise to the problem of calcification of the housing of the heat exchanger.

A plate heat exchanger is known from DE 20 2008 003 349 U1 which basically stands in an upright position to counteract the aforementioned problem of decalcification. The plate heat exchanger is oriented such that a surface normal on the plates of the heat exchanger is perpendicular to the gravitational field of the earth. The housing of the plate heat exchanger, however, is there pivoted about this surface normal so that the housing is in an inclined position. The inlet of the primary circuit and the outlet of the secondary circuit are provided in the region of the base of the heat exchanger. Due to the inclination, that portion of cold water remaining in the housing of the heat exchanger after hot water is dispensed is located below the outlet of the secondary circuit in the housing. When hot water is dispensed the following time on the secondary side, however, not the cold water portion is first dispensed.

A plate heat exchanger is known from DE 10 2010 018 086 A1 which builds on an orientation of the plates like it is known from DE 20 2008 003 349 U1. In DE 10 2010 018 086 A1 as well, a surface normal on the plates of the heat exchanger is perpendicular to the gravitational field of the earth but differs from the orientation known from DE 20 2008 003 349 U1 in that the longitudinal axis of the plates include a greater angle with the gravity field vector. Furthermore, the warm end of the plate heat exchanger, i.e. the inlet for the warmer medium, is with respect to the longitudinal axis provided at the upper end of the plate heat exchanger and the cold end, i.e. the inlet for the colder medium, at the lower end.

The solutions of DE 20 2008 003 349 U1 and DE 10 2010 018 086 A1 are further characterized in that therein, the channels of the plate heat exchanger are oriented vertically in the gravitational field.

However, also the solutions previously known from DE 20 2008 003 349 U1 and DE 10 2010 018 086 A1 still provide room for improvement. Because even these solutions only insufficiently counteract calcification.

BRIEF DESCRIPTION

The present invention seeks to provide a plate heat exchanger system that gives consideration to the problem of calcification in an improved manner and avoids it to the extent possible.

To solve this problem, the present invention proposes a plate heat exchanger having the features of claim 1. This system differs from prior art in that the plate heat exchanger is in the gravitational direction arranged such that the plane, in which the plate is located, is inclined relative to the gravity vector and the horizontal.

Plates of a plate heat exchanger typically have wavy or otherwise deformed sections so that such a plate does not form a completely flat surface. The plane in which the plate is located is therefore in particular to be understood to be that plane in space which includes the surface portions of the plate that have not been deformed in the provision process of the plate. The proportion of the surface portions of the plate that were not deformed and that are therefore located in one plane is preferably at least 10%, preferably at least 50% and particularly preferably at least 85% of the total area of the plate. Should the plate be deformed over its entire surface, then two directions L and B (usually referred to as the length and width) can nevertheless be determined in which the plate has its greatest extension. If the plate is deformed over its largest or entire surface or if no flat surface portions can be identified in which the sheet metal material of the plate has not been deformed, then the plane in which the plate is located is in particular to be understood as being that plane in space which is spanned by the two vectors pointing in direction L and B.

According to the present invention, a surface normal to the plane in which the plate is located is accordingly provided inclined to the gravitational field of the earth, i.e. at an angle greater than 0° and less than 90°. The plate heat exchanger of the plate heat exchanger system according to the invention usually comprises several such plates which are provided in parallel planes and stacked and which each decouple the primary circuit in terms of fluid from the secondary circuit and divide alternating compartments for the primary circuit and the secondary circuit within the housing. If after dispensing warm water from the secondary circuit, the flow therein is stopped, then fluid in part still to be heated and in part already heated fluid is located within the heat exchanger.

It is for the subsequent illustration of the concept underlying the invention assumed that the fluid is warm water which when flowing through the heat exchanger on the primary side on the primary side in the gravitational field of the earth flows bottom to top. This warm water is then the fluid of the primary circuit. The water of the secondary circuit is directed in counter current thereto, i.e. it flows in the gravitational field of the earth from top to bottom. If, after dispending warm water from the secondary circuit, this dispensing is then stopped, then relatively cold water is located in the inlet region of the secondary circuit (i.e. generally in the gravitational field of the earth at the top), whereas the water at the outlet side (i.e. generally in the gravitational field of earth at the bottom) is relatively warm.

Due to the higher density, the cold water in the gravitational field of the earth displaces the warm water having a lower density. Due to the inclination of the heat exchanger, the water in the compartment relatively soon encounters the wall that is formed by a plate and defines the respective compartment of the heat exchanger. This plate can also be formed by an outer housing wall of the heat exchanger. The downward motion of the cold water is thereby stopped. The cold water now slides downwardly on the inclined surface. A micro-circulation arises in the region of the respective compartment. In counter current to the cold water, relatively warm water flows upwardly in the same or an adjacent compartment due to the continuity of the medium. For the flow in one compartment, a certain mixing occurs due to circulation at the boundary area between the falling and the rising water. Moreover—provided that the plate heat exchanger is a heat exchanger having a plurality of plates provided in parallel and a plurality of alternating compartments, firstly, for the primary and, secondly, for the secondary circuit—the fluid of the secondary circuit is also slightly heated by the fluid in the compartment of the primary circuit located thereunder. This causes effective equalization of the temperature of the fluid of a different temperature that is first present in the compartment after the circulation is stopped. Insofar as water is presently geared toward as being the fluid, only the fact that this fluid is typically used—at least in the secondary circuit—is thereby accounted for. However, the invention is not restricted to this fluid.

According to a preferred development of the present invention, the plate heat exchanger is in the direction of gravity disposed such that a surface normal to the plane in which the plate is located is inclined by an angle between 9° to 50° relative to the gravity vector, more preferably at an angle of between 10° and 50° and very preferably at an angle of between 15° and 35°. The optimum is likely given for a plate heat exchanger whose surface normal to the plane in which the plate is located is inclined by an angle of 25° relative to the gravity vector.

The plate heat exchanger is commonly integrated into a heat exchanger system which comprises at least one dispenser for drinking water or service water, respectively. The plate heat exchanger system according to a preferred development of the present invention comprises a respective line which is part of the secondary circuit and leads to a dispensing point for drinking or service water, respectively.

As already mentioned, the fluid of the primary heating circuit in the heat exchanger preferably flows uphill, i.e. against gravity and the fluid of the secondary circuit in the heat exchanger flows in the opposite direction. The heat exchanger is therefore a counter-flow heat exchanger. If dispensing of water is stopped, then the cold water of the secondary circuit accordingly first flows downwardly until it encounters the inclined boundary area defining the respective compartment at the lower side. This boundary area can be formed by a plate in the interior of the housing or just by the housing of the heat exchanger. If the circulation of the fluid circulating in the primary circuit is stopped, it likewise descends in the same way and approaches that region of the compartment in which relatively warmer fluid is provided. A relatively uniform temperature is thereby rapidly obtained in both compartments by the preferred development mentioned, provided that the flow in the heat exchanger comes to a standstill.

The primary circuit is preferably located in the housing above the secondary circuit. It is therefore ensured in particular for a heat exchanger with only one compartment for each of the circuits that the relatively colder fluid within the primary circuit first descends in the direction toward the even colder fluid within the secondary circuit and that therefore a certain convective heat transfer is obtained at the boundary layer between both circuits and through the plate separating the two circuits. Typically, a plurality of compartments is arranged one above the other in the plate heat exchanger and commonly assigned in a periodically alternating manner to the primary and the secondary circuit. The development discussed above therefore requires that a compartment for the primary cycle is provided as the uppermost compartment and a lowermost compartment for the secondary circuit.

According to a further preferred embodiment of the present invention, the housing of the plate heat exchanger is oriented in an inclined manner. The inclination of the plate heat exchanger housing commonly corresponds to the inclination of the individual plates of the housing. Accordingly, the plates of the housing are oriented parallel to the longitudinal extension of the heat exchanger housing. The housing comprises a vent valve for the primary circuit and a vent valve for the secondary circuit. It is understood that these vent valves are in the vertical direction provided on the upper edge of the housing.

A simplified connection of pipes of the primary and the secondary circuit of the present invention is improved in that the housing of the plate heat exchanger comprises respective ports at the underside for the primary circuit and/or the secondary circuit.

According to a further preferred embodiment of the present invention, all ports for the primary and the secondary circuit are provided at the underside of the plate heat exchanger housing. All assembly work for connecting the piping systems must therefore be done only from the underside. The heat exchanger with its housing can for this be mounted at a suitable location in order to further facilitate this connection work.

As is it arises from the foregoing description, the present invention provides for the option of improving the cooling-down time within the heat exchanger, i.e. to reduce the time necessary to respectively bring about substantially constant temperature conditions in the two circuits within the heat exchanger housing over the entire volume extension of the respective circuits. This overall counteracts the problem of increased calcification of the compartments in the heat exchanger and of the heat exchanger as a whole. The inclination of the at least one plate ultimately leads to a kind of circular convection flow within the compartment of one of the cycles that causes the best possible equalization of temperature within that compartment. This quickly achieves a uniform mixed temperature in the respective compartment, which respectively represents the temperature of the fluid in the compartment or in the entire heat exchanger, respectively, which arises after mixing fluid portions of different temperatures in one of the circuits within the heat exchanger.

BRIEF DESCRIPTION OF THE DRAWINGS

Further advantages and features of the present invention can be gathered from the following description of an embodiment in combination with the drawing, in which.

DETAILED DESCRIPTION

Figure 1:
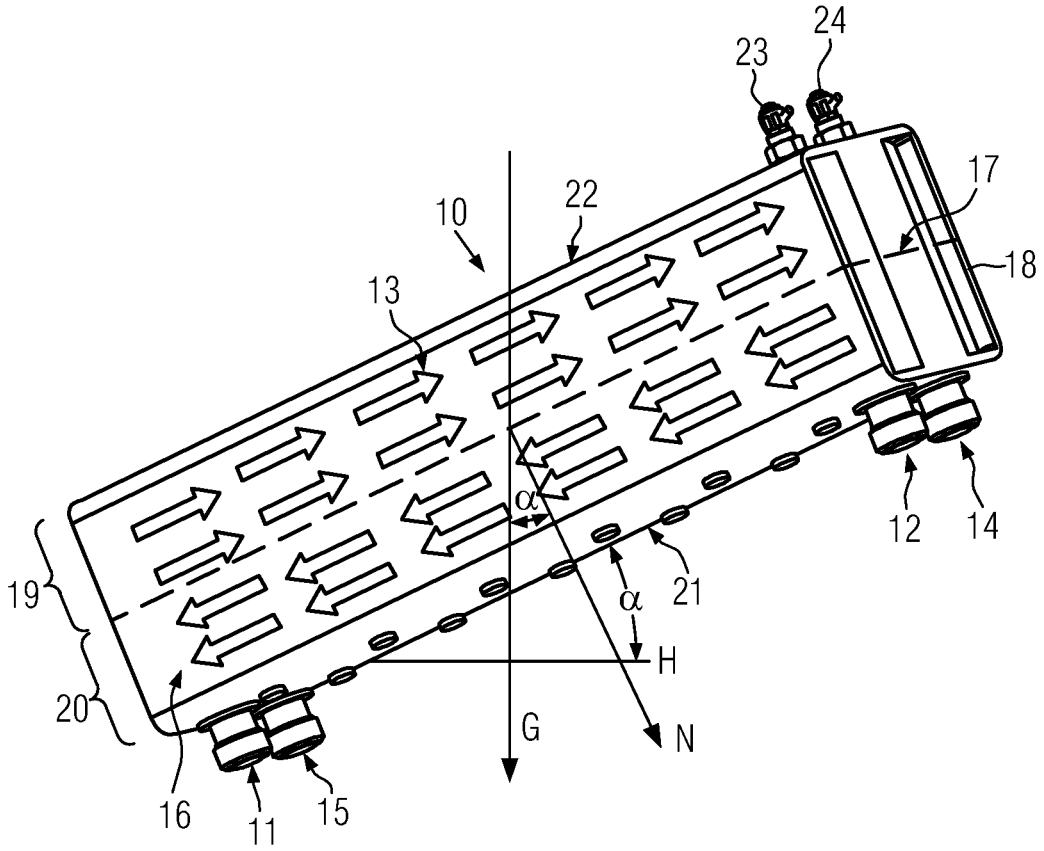
FIG. 1 shows a perspective side view of an embodiment of a plate heat exchanger and FIG. 2 shows a schematic system illustration of an embodiment of a plate heat exchanger system.

FIG. 1 illustrates a perspective side view of an embodiment of a plate heat exchanger 10 with an inlet 11 and an outlet 12 of a primary circuit 13, an inlet 14 and an outlet 15 of a secondary circuit 16, and a plate 17 indicated above a dot-dashed line which separates the two circuits 13, 16 from each other.

Plate 17 separates the interior of a housing—marked with reference numeral 18—of plate heat exchanger 10 into two compartments 19, 20. Compartment 19 is the flow region for the fluid flowing in the primary circuit. In compartment 20, the fluid of secondary circuit 16 flows through housing 18. As is evident, inlet 11 of the primary circuit and outlet 15 of the secondary circuit are located at the bottom edge of housing 18 near an edge which is defined by a front end of housing 18. Outlet 12 of the primary circuit and inlet 14 of the secondary circuit are located at the opposite end of an underside of housing 18. This underside is defined by a side wall 21 of housing 18. Compartment 19 for primary circuit 13 is at the upper side defined by an upper side wall 22 of the housing. This upper side wall 22 of the housing is at its upper end near the front side provided by two vent valves 23, 24 [sic]. It is understood that a plurality of compartments of the kind described above can be arranged in the plate heat exchanger above each other and alternately. Only one compartment was illustrated, namely enlarged, to express the essence of the invention more clearly. The respective compartments are at the end side in communication with inlets 11, 14 and outlets 12, 15, respectively.

The horizontal is in FIG. 1 indicated by line H. The inclination of the housing, i.e. walls 21, 22 provided in parallel relative to this horizontal H, is marked by angle $\alpha$. Presently, $\alpha=35°$. Also plate 17 is inclined relative to horizontal H at a respective angle. Perpendicular thereto, G shows the gravitational field of the earth. Plate 17 separating the compartments has a surface normal N which runs at the same angle $\alpha$ relative to vector G of the gravitational field of the earth.

Figure 2:
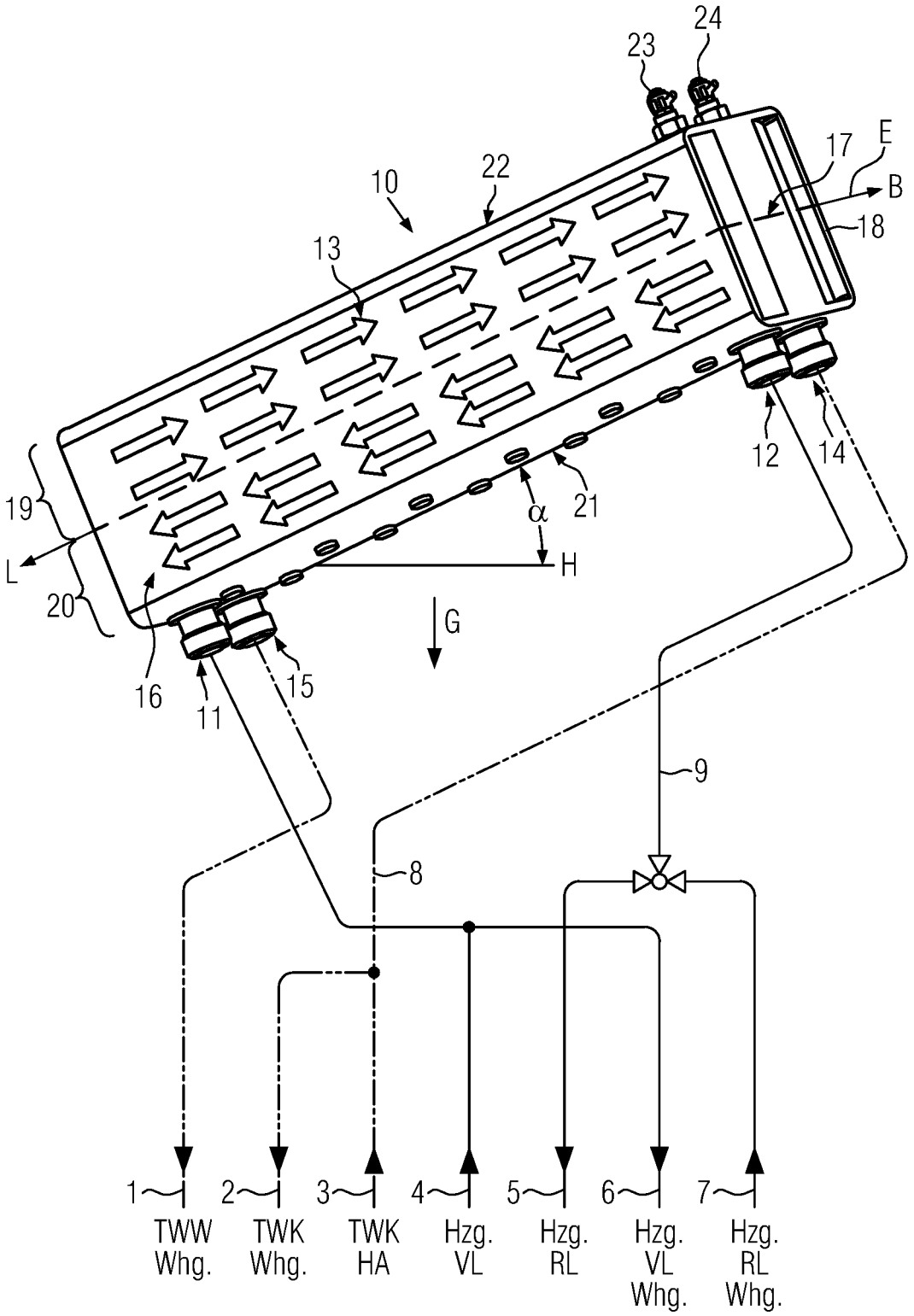

FIG. 2 shows the installation situation of the embodiment illustrated in FIG. 1 with the connection lines which are connected to respective lines for warm water (TWW), for cold water which is provided by the domestic connection (TWK HA), for heating water (Hzg.), where VL depicts the flow and RL the return. The heating pipes with the further index Whg. are connected to the house and are the flow and return for the house unit. The corresponding line sections are numbered with reference numerals 1 to 7. Line section 8 connects inlet 14 of the secondary circuit for drinking water of plate heat exchanger 10 with a branch to which lines 2 and 3 are connected. The outlet of secondary circuit 15 is connected to line 1. The inlet of primary circuit 11 is via a T-piece connected to line 4 for the heating flow. Outlet 12 of the primary circuit is via conduit 9 and a three-way valve in communication with line 5 for the heating return, which can also via the three-way valve be connected to heating return line 7 coming from the house. Lines 5 and 4 carry the heating water via a heating boiler, not shown, in which the heating water is heated.

The conceivable installation situation of the plate heat exchanger in the plate heat exchanger system shown in FIG. 2 is thereby exemplified.

The flow arrows drawn in in FIG. 1 indicate the circulation due to free convection after switching off any flow due to forced convection, which results in rapid temperature equalization within the heat exchanger, namely, due to the inclined orientation of the walls defining individual compartments 19, 20. The quite cold fluid of primary circuit 13 located relatively far at the top has a higher density than the slightly warmer fluid of the same circuit 13 located therebeneath. The same applies for the relatively cold fluid of the secondary circuit 16 located in the region of inlet 14 in relation to the fluid of the same circuit located close to outlet 15. The colder fluid has a stronger tendency to descend due to the higher density. When descending, it presses the relatively warm fluid of the same compartment 19 or 20 upwardly. This results in a micro-circulation due to the different densities which only reaches a standstill when the temperature within the compartments is substantially equalized. Faster temperature equalization and therefore less calcification arise with the solution according to the invention.

In FIG. 2 at the height of plate 17, its length L and its width B are marked in the form of direction vectors. Direction vector L there denotes the direction of the greatest extension, i.e. the length extension of plate 17, and vector B denotes the direction of the extension of the plate in the second greatest direction, i.e. the width direction. Vectors L and B presently span a plane E to which the surface normal N is oriented orthogonally. The presently flat plate 17 is there located entirely within this plane E and itself defines this plane E.

LIST OF REFERENCE NUMERALS

10 plate heat exchanger
11 inlet of the primary circuit
12 outlet of the primary circuit
13 primary circuit
14 inlet of the secondary circuit
15 outlet of the secondary circuit
16 secondary circuit
17 plate
18 housing
19 compartment for primary circuit 13
20 compartment for secondary circuit 16
21 lower side wall
22 upper side wall
23 vent valve
24 vent valve
G direction of gravity
H horizontal
N surface normal
$\alpha$ angle of inclination
L direction of greatest extension
B direction of second greatest extension
E plane

The invention claimed is:

1. A plate heat exchanger system with a plate heat exchanger (10) comprising an inlet (11) and an outlet (12) of a primary circuit (13), an inlet (14) and an outlet (15) of a secondary circuit (16), and at least one plate (17) separating said two circuits in a housing of said plate heat exchanger from each other, wherein said plate heat exchanger (10) in the direction of gravity (G) is arranged such that a plane (E), in which said plate (17) is located, is inclined relative to the gravity vector (G) and a horizontal (H), wherein the housing of the plate heat exchanger (10) comprises a vent valve (23) for said primary circuit (13) and a vent valve (24) for said secondary circuit (16), and wherein said vent valves (23, 24) are provided on an upper surface (22) of the housing.

2. The plate heat exchanger system (10) according to claim 1, characterized in that said secondary circuit (16) comprises a line that leads to a dispensing point for drinking or service water, respectively.

3. The plate heat exchanger system (10) according to claim 2, characterized in that the fluid of said primary heating circuit flows against gravity and the fluid of said secondary circuit (16) in the opposite direction.

4. The plate heat exchanger system (10) according to claim 1, wherein all ports for said primary circuit (13) and said secondary circuit (16) are provided underside (21) of said housing (18).

* * * * *